US006698225B2

(12) United States Patent
Chaves

(10) Patent No.: US 6,698,225 B2
(45) Date of Patent: Mar. 2, 2004

(54) BIASED CONDENSATION TRAP

(76) Inventor: Manuel J. Chaves, 276 Manning St., Hudson, MA (US) 01749-1037

( * ) Notice: Subject to any disclaimer, the term of this patent is extended or adjusted under 35 U.S.C. 154(b) by 0 days.

(21) Appl. No.: 10/225,560

(22) Filed: Aug. 21, 2002

(65) Prior Publication Data

US 2003/0037561 A1 Feb. 27, 2003

Related U.S. Application Data

(60) Provisional application No. 60/314,279, filed on Aug. 22, 2001.

(51) Int. Cl.[7] ..... F25D 21/14; F16K 13/00; F16K 13/10; F16L 43/00; F16L 55/24

(52) U.S. Cl. ..... 62/285; 62/297; 137/247.13; 137/247.51

(58) Field of Search ..... 62/285, 291; 137/247.51, 137/247.13

(56) References Cited

U.S. PATENT DOCUMENTS 3,896,839 A * 7/1975 Austin, Jr. ..... 137/216.1
4,693,091 A * 9/1987 O'Mara et al. ..... 62/272
4,918,935 A * 4/1990 Trent ..... 62/93
5,038,816 A * 8/1991 Weltsch ..... 137/247.51
5,267,361 A * 12/1993 Lai ..... 4/679
5,499,514 A * 3/1996 Ho ..... 62/291
5,557,942 A * 9/1996 Kim et al. ..... 62/288

* cited by examiner

*Primary Examiner*—William C. Doerrler
*Assistant Examiner*—Filip Zec
(74) *Attorney, Agent, or Firm*—Fish & Richardson P.C.

(57) ABSTRACT

A condensate trap for an air conditioning system includes a chamber having an upstream port coupled to the air conditioning system and a downstream port coupled to the external atmosphere, a sealing device disposed in the chamber. Whether the trap is used with a blow-through or a draw-through system, the spring keeps the sealing device in contact with the upper seat member until the force of the spring is overcome by the weight of condensate accumulating on top of the float plus or minus the pressure exerted by the air conditioning system. When the spring force exerted on the sealing device is overcome, the sealing device moves out of contact with the upper seat member and the condensate drains from the trap.

20 Claims, 3 Drawing Sheets

BIASED CONDENSATION TRAP

This application claims benefit of Provisional No. 60/314,279 filed Aug. 22, 2001.

BACKGROUND OF THE INVENTION

The invention relates to removing condensate from air conditioning systems as well as other systems or devices that collect condensation.

Air conditioning systems generally include a blower which blows or draws air over a heat exchanger coil on which condensation accumulates and drips to a discharge pan positioned below the coil. The condensation (or condensate) which overflows from the pan is drained from the system through a discharge port on to the ground or into the sewer system.

Referring to FIG. 1A, an air conditioning system 10 includes a blower 11 positioned to draw external air through a filter 14 and push the air over a heat exchanger 12, thereby presenting positive pressure at the discharge port where the condensate is discharged. A system having the blower positioned with respect to the heat exchanger in this manner is known as a "blow-through" system. Condensate from the heat exchanger drips into a condensate pan 13 having a drain port 15 connected to a U-shaped condensate trap 16.

Referring to FIG. 1B, on the other hand, if the blower is positioned to draw air over the coil, the system is a "draw-through" system with a negative pressure present at the port where the condensate is discharged. With this arrangement, blower 11 is positioned to pull air through the heat exchanger.

A condensate trap 16 in the form of U-shaped piping is generally provided at the discharge port. In a draw-through type system, the U-shaped trap 16 must be filled with water prior to starting up the system. In this case, the water serves as a barrier and is necessary in preventing the condensate pan from overflowing when the system is initially started up. In a blow-through type system, there is no requirement for "priming" the system because condensation will accumulate during operation. In either case, the water in the trap forms a barrier between atmospheric pressure at the discharge port of the trap and the pressure level within the system, thereby preventing escape of conditioned air in the system of FIG. 1A or introducing air into the system of FIG. 1B. The trap also collects foreign material (e.g., sediment) passed through the discharge pan from the system. This foreign material can collect in the bottom of the trap and clog the system.

SUMMARY OF THE INVENTION

The invention is related to a condensate trap for use with an air conditioning system allowing trapped condensate and foreign material collected in the trap to be safely removed from the system.

In a general aspect of the invention, the condensate trap for an air conditioning system includes a chamber having an upstream port for coupling to the air conditioning system and a downstream port open to the external atmosphere, a sealing device disposed in the chamber, an upper seat member disposed between the sealing device and upstream port, and a lower seat member whose upper surface is adapted to receive a biasing member which is disposed between the sealing device and the lower seat member. The biasing member maintains the sealing device in biased contact with the upper seat member to prevent the egress or ingress of air from or into the air conditioning system.

Moreover, in response to a predetermined amount of condensation fluid accumulating in the chamber, the sealing device moves out of contact with the upper seat member to allow the fluid to drain from the downstream port of the chamber.

Embodiments of this aspect of the invention may include one or more of the following features. The biasing member is a spring, or a tube or rod made from rubber or other resilient material. The sealing device is a float, for example, a round and hollow ball. The chamber is formed as a cylindrical pipe. The upper seat member includes a gasket seated in upper seat member. The lower seat member also includes a gasket seated in lower seat member, the gasket having an upper surface adapted to support the biasing member. The cylindrical pipe is formed of a transparent material to allow the installation or service technician to visually inspect and ensure that the condensate trap is properly operating.

Among other advantages of the invention, infiltration of air into and out of the system is minimized, thereby reducing pressure imbalances within the building. Preventing transfer of air between the air conditioning system and external atmosphere is achieved by the trap whether the system is used with a draw-through or blow-through system. For example, when used with a draw-through system, the trap prevents air from the external atmosphere (which may be polluted) from infiltrating the system. When used with a blow-through system, the trap prevents loss of air from the air conditioning system to the external atmosphere. In either case, the trap also prevents collected condensate or other foreign matter (e.g., sediment) from accumulating in the trap. The trap is configured to allow the condensate and foreign matter to drain from the system through the bottom of the trap. Thus, unlike conventional U-traps, sediment which can clog the trap does not accumulate in the trap. Moreover, the trap isolates the air conditioning system from the external atmosphere, without requiring the use of fluid (e.g., collected condensate) which is required in conventional U-piping traps. Thus, in the present invention, there is no risk of damaging the trap due to freezing of the fluid in the trap.

The condensate trap is compact, easy to install, and is easily removed from the system for maintenance or repair. The trap can be installed at virtually any point along the length of the drain pipe. For example, the trap can be installed at the end of an outdoor drain pipe and should be accessible for cleaning. In humid environments (e.g., regions of the southern United States) certain types of algae can grow on and within the trap. In such environments, it may be advantageous to have the trap outside where ultraviolet light will help prevent the growth of algae. The trap can also be directly substituted for a conventional U-piping trap without requiring any modification to the existing air conditioning or duct system. The spring is made from a non-corrosive material, such as stainless steel, and the length or other dimension of the spring can be changed to match requirements of different systems. Other features and advantages directed to the construction and materials of the condensate trap 20 are discussed in U.S. Pat. No. 5,644,925, which is incorporated herein by reference.

Other features and advantages of the invention will become apparent from the following detailed description, and from the claims.

DETAILED DESCRIPTION

Figure 1A:
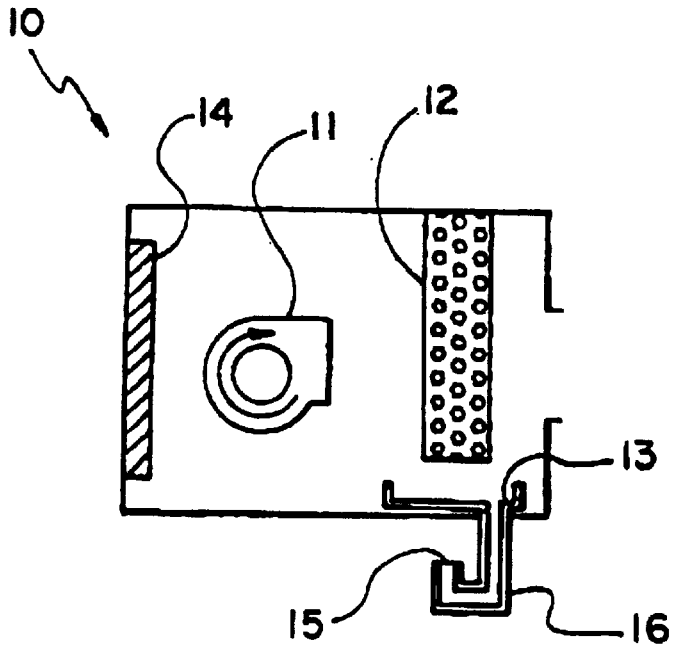
FIG. 1A is a schematic representation of a conventional blow-through type system.
Figure 1B:
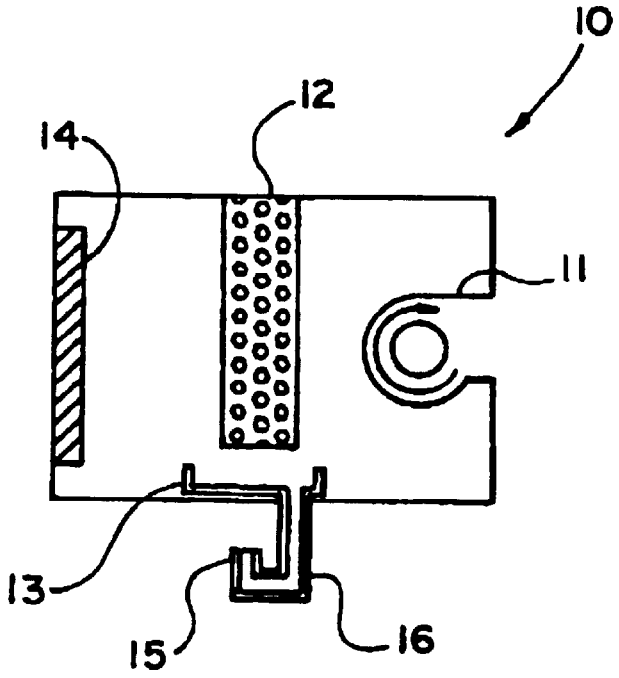
FIG. 1B is a schematic representation of a conventional draw-through type system.
Figure 2:
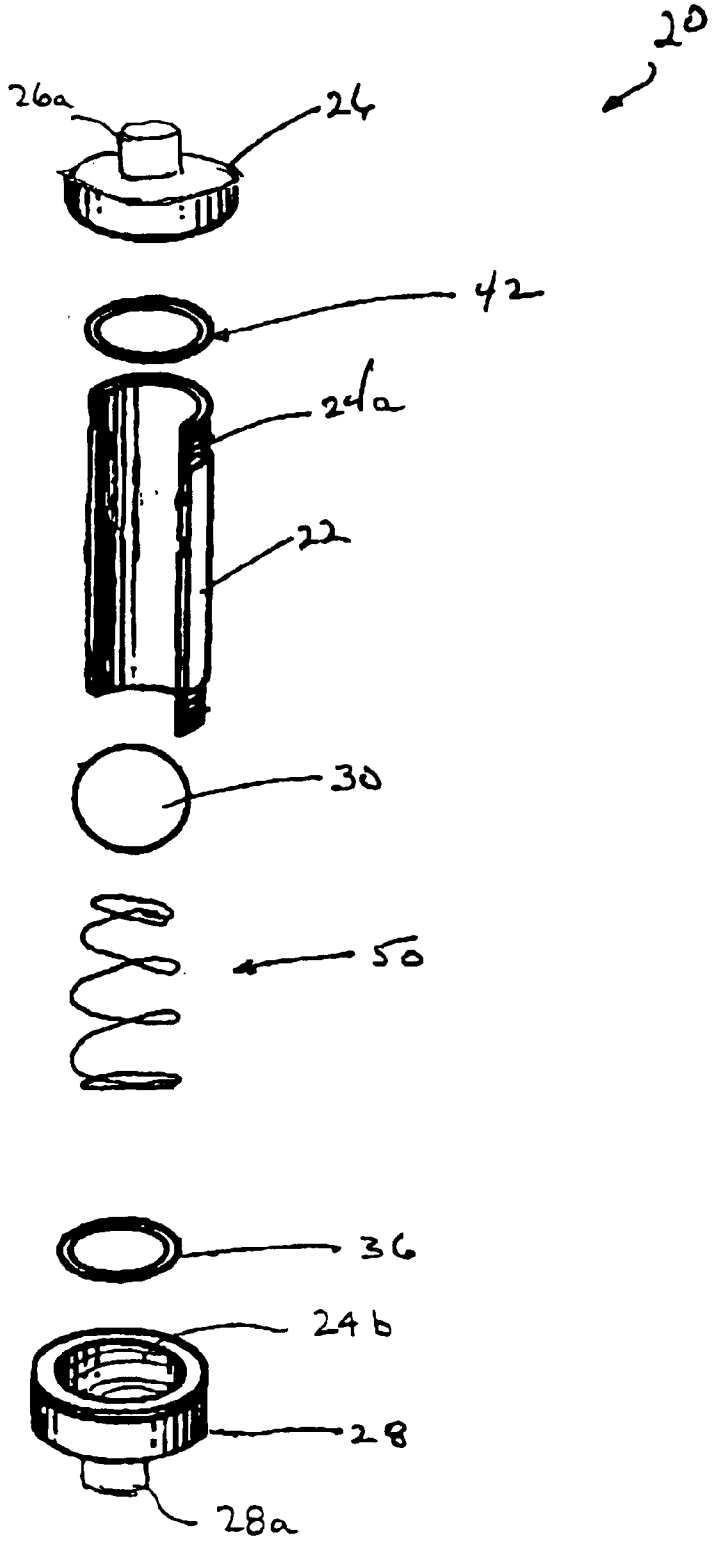
FIG. 2 is a perspective, exploded view of the condensate trap in accordance with the invention.

Referring to FIG. 2, a condensate trap 20 which may be substituted for the U-shaped traps 16 shown in FIGS. 1A and 1B is shown. Condensate trap 20 includes a transparent cylindrical tube 22 having a length of approximately two inches (drawing not to scale) and an inner diameter of 1 ½ inches. Tube 22 is formed of PVC plastic and includes threads 24A at its ends for receiving corresponding threads 24B of adapting fixtures 26, 28. Adapting fixtures are used to connect tube 22 to the rest of the air conditioning system and the discharge piping, respectively. In particular, fixtures 26, 28 include inlet and outlet ports 26*a*, 28*a*, respectively (see FIG. 3A), which extend about the axis of the tube. Fixtures 26, 28 are rotatable about the axis of the tube to facilitate connecting it to the piping of the air conditioning system and discharge piping. It is important that condensate trap 20 must be mounted in a substantially vertical position.

In other embodiments, tube 22 and fixtures 26, 28 are threadless. In these embodiments, a pair of threaded fasteners (not shown) are used to clip a pair of surfaces extending outwardly (not shown) from fixture 28 and are received through holes defined by fixture 26.

A round hollow float 30 (e.g., a ping pong ball) having a diameter slightly less than the diameter of the tube is positioned in tube 22 and is kept in biased contact by a biasing member 50 (e.g., a spring) with a gasket 42 which is formed of rubber and is seated within the upper adapting fixture 26. Float 30 can be formed of a variety of materials including plastic and lightweight metal. A gasket 36, also formed of rubber, is placed in lower adapting fixture 28 and has an upper surface adapted to receive biasing member 50. Biasing member 50 is preferably formed of a non-corrosive material such as stainless steel, rubber, or plastic and under normal operating conditions biases float 30 against gasket 42 thus preventing the ingress or egress of air into or out of the air conditioning system.

Figure 3A:
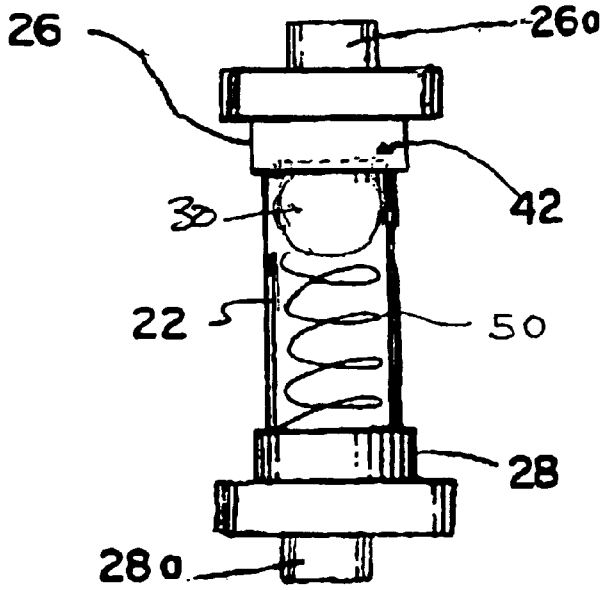
FIG. 3A is a side view showing the condensate trap of FIG. 2 in use with a draw-through and a blow-through system where the weight of the water is not sufficient to deflect the sealing device.
Figure 3B:
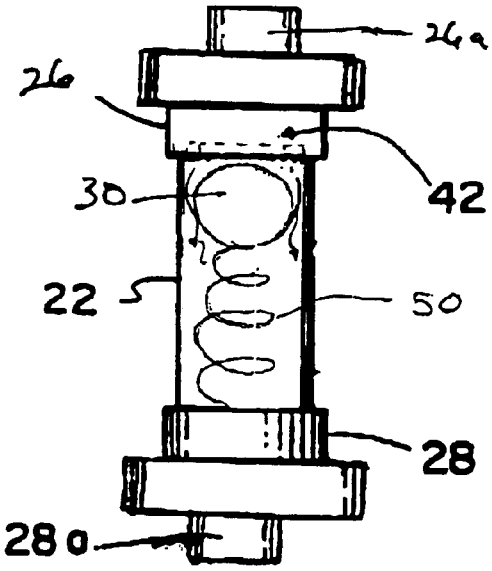
FIG. 3B is a side view showing the condensate trap of FIG. 2 in use with a draw-through or a blow through system where the weight of the water is sufficient to deflect the sealing device.

Referring to FIGS. 3A and 3B, in a draw-through system, when the blower is activated, a negative pressure within the tube relative to the external atmosphere exists. Condensate 35 draining into the chamber from the condensate pan accumulates on top of float 30 until the weight of the condensate overcomes the negative pressure exerted on the float by the air conditioning system and the force exerted on float 30 by biasing member 50; thus allowing the condensate to drain around the float and to outlet port 28*a* of the trap (see FIG. 3B). With the weight of the condensate removed, float 30 is pushed back into position against gasket 42 by biasing member 50 and the negative pressure (see FIG. 3A).

Similarly, in a blow-through system, when the blower is activated, a positive pressure exists within the tube relative to the external atmosphere. The positive pressure tends to push float 30 toward lower adapting fixture 28. The force exerted by biasing member 50 against float 30 is such that float 30 maintains contact with gasket 42. Condensate 35 drains into tube 22 and accumulates on top of float 30 until the weight of the condensate plus the positive pressure overcomes the force of the spring exerted on float 30 and the condensate drains to outlet port 28*a* of the trap (see FIG. 3B). With the weight of the condensate removed, float 30 is pushed back into position against gasket 42 by biasing member 50 (see FIG. 3A).

Thus, isolation between the air conditioning system and external atmosphere is maintained at all times whether the condensate trap is used with a draw-through or blow-through system even during periods in which the system is not operated.

Other embodiments are within the scope of the claims. For example, the float, chamber, seals and ports may be any of a variety of materials (e.g., plastics, metals, glass, rubber) and shapes. Furthermore, it is important to appreciate that the invention is not limited to air conditioning systems but is applicable to any system or device that collects condensation.

What is claimed is:

1. A condensate trap comprising:

a chamber having an upstream port and a downstream port open to the external atmosphere;

a sealing device disposed in the chamber; and a biasing member disposed in the chamber configured to position the sealing device to prevent air from passing through the upstream part to the external atmosphere in a positive pressure mode; and wherein in response to a predetermined amount of condensation fluid accumulating in the chamber, the biasing member is configured to allow the sealing device to move and allow the fluid to drain from the downstream port of the chamber.

2. The condensate trap of claim 1 further comprising:

an upper seat member disposed in the chamber between the sealing device and the upstream port;

a lower seat member disposed in the chamber, the lower seat member having an upper surface sized to receive the biasing member.

3. The condensate trap of claim 2 wherein in response to the predetermined amount of condensation fluid accumulating in the chamber, the biasing member is configured to deflect and the sealing device moves out of contact with the upper seat member to allow the fluid to drain from the downstream port of the chamber.

4. The condensate trap of claim 1 wherein the biasing member is a spring.

5. The condensate trap of claim 1 wherein the sealing device is a float.

6. The condensate trap of claim 5 wherein the float is a hollow round ball.

7. The condensate trap of claim 1 wherein the chamber comprises a cylindrical tube.

8. The condensate trap of claim 7 wherein the cylindrical tube is formed of a transparent material.

9. The condensate trap of claim 2 wherein the upper seat member comprises a gasket.

10. A condensate trap comprising:

a chamber having an upstream port and a downstream port open to the external atmosphere;

a sealing device disposed in the chamber;

an upper seat member disposed in the chamber between the sealing device and the upstream port;

a biasing member disposed in the chamber configured to allow the sealing device to move against the upper seat member to prevent the ingress of air from the external atmosphere through the chamber in a negative pressure mode;

a lower seat member disposed in the chamber, the lower seat member having an upper surface sized to receive the spring.

11. The condensate trap of claim 10 wherein in response to a predetermined amount of condensation fluid accumulating in the chamber, the biasing member deflects and the sealing device moves out of contact with the upper seat member to allow the fluid to drain from the downstream port of the chamber.

12. A condensate trap comprising:

a chamber having an upstream port and a downstream port open to the external atmosphere;

a sealing device disposed in the chamber; and a biasing member disposed in the chamber and, in response to predetermined amount of condensation fluid accumulating in the chamber, the biasing member is configured to allow the sealing device to move and allow the fluid to drain from the downstream port of the chamber.

13. The condensate trap of claim 12 further comprising:

an upper seat member disposed in the chamber between the sealing device and the upstream port;

a lower seat member disposed in the chamber, the lower seat member having an upper surface sized to receive the biasing member.

14. The condensate trap of claim 12 wherein the biasing member is configured to position the sealing device to prevent air from passing through the upstream part to the external atmosphere in a positive pressure mode.

15. The condensate trap of claim 12 wherein the biasing member is a spring.

16. The condensate trap of claim 12 wherein the sealing device is a float.

17. The condensate trap of claim 16 wherein the float is a hollow round ball.

18. The condensate trap of claim 12 wherein the chamber comprises a cylindrical tube.

19. The condensate trap of claim 18 wherein the cylindrical tube is formed of a transparent material.

20. The condensate trap of claim 13 wherein the upper seat member comprises a gasket.

* * * * *